United States Patent [19]

Murakami

[11] 4,411,097

[45] Oct. 25, 1983

[54] DOLL WITH MOVABLE ARMS, LEGS AND HEAD ACCOMMODABLE WITHIN TRUNK

[75] Inventor: Katsuji Murakami, Tokyo, Japan

[73] Assignee: Kabushiki Kaisha POPY, Tokyo, Japan

[21] Appl. No.: 302,522

[22] Filed: Sep. 16, 1981

[30] Foreign Application Priority Data

Dec. 4, 1980 [JP] Japan ..... 55-174243[U]

[51] Int. Cl.[3] ..... A63H 3/00; A63H 3/46

[52] U.S. Cl. ..... 46/161

[58] Field of Search ..... 46/115, 116, 153, 161, 46/163

[56] References Cited

U.S. PATENT DOCUMENTS

| | | | |
|---|---|---|---|
| 1,509,604 | 9/1924 | Myers | 46/161 |
| 2,144,751 | 1/1939 | Brown | 46/161 X |
| 2,325,750 | 8/1943 | De Vries | 46/153 |
| 2,615,283 | 10/1952 | Seligson | 46/161 |
| 2,623,329 | 12/1952 | Di Leva | 46/161 |
| 2,797,516 | 10/1956 | Del Mas | 46/161 |
| 3,831,316 | 8/1974 | Weistrop | 46/153 |

FOREIGN PATENT DOCUMENTS

| | | | |
|---|---|---|---|
| 104280 | 3/1917 | United Kingdom | 46/161 |

*Primary Examiner*—F. Barry Shay

*Attorney, Agent, or Firm*—Armstrong, Nikaido Marmelstein & Kubovcik

[57] ABSTRACT

A toy doll is provided of which the head, arms and legs are capable of being fully accommodated within the trunk whereby the outer appearance represents a rectangular prism. The toy doll of the invention has a trunk being of a generally box shape and having an inner space including an upper room and a lower room divided by a partition disposed centrally and horizontally of the inner space. The trunk is also provided an upper lid and a lower lid each respectively covers the upper and lower rooms. The head and arms are accommodated within or emerged out of the upper room, while the legs within or out of the lower room.

5 Claims, 5 Drawing Figures

DOLL WITH MOVABLE ARMS, LEGS AND HEAD ACCOMMODABLE WITHIN TRUNK

BACKGROUND OF THE INVENTION (1) Field of the Invention

This invention relates to a doll toy and, more particularly to a doll toy incorporating features of a superman and robot and having its arms, legs and head accommodatable within its trunk. The outer appearance the arms, legs and head are within the trunk looks like a box shape.

(2) Description of the Prior Art

In a conventional doll toy which is customarily construction from main elements such as a head, a trunk, arms and legs, it is necessary in order to put the doll toy in a toy case or some other place to have sufficient space for receiving the doll toy. The minimum space is determined by the length from the top of the head to the bottom of the foot, the width of the both shoulders, and the depth of the trunk. As a result, in accordance with the overall length of the toy doll, which varies from a small one to a large one, it is sometimes necessary to prepare a relatively large space for putting the doll toy away.

Moreover, since the arms, legs and head outwardly extend from the trunk, the arms, legs and head have been susceptible to damage or destruction when the toy doll is moved or put in the toy case due to the contact or abrasion with the other materials in the case. This is especially so in such a toy doll whose head, legs and arms are highly decorated with accessories.

SUMMARY OF THE INVENTION

It is therefore a principal object to provide a novel and improved toy doll which is capable of being housed in a toy case or some other places without occupying a large capacity.

It is another object to provide a novel and improved toy doll as above described in which the head, arms and legs can be accommodated within the trunk when not used thereby to have an outer appearance of a box like shape.

It is a further object to provide a novel and improved toy doll as above described which is free from damage, or destruction of the head, arms and legs during it is handled or housed in a toy case or some other place.

According to this invention, these and further objects can be accomplished by providing a toy doll of the type wherein a head, shoulders, arms, hands, legs and feet are articulated to a trunk which is of a generally box shape and defines a chest, abdomen, back, waist and hips. Briefly the toy doll according to the present invention has the feature that the head, shoulders, arms, hands, legs and feet are fully accommodated within the trunk when the toy doll is not used or housed in a toy case or other places, while contrary to the above, when used, these members are extended out of the trunk.

In accordance with an aspect of the invention, the trunk has horizontally and centrally of the inner space a partition which defines an upper room and lower room within the trunk and fixedly connects at one edge an upper lid on its upper hinge for pivotal movement in a vertical direction, and at the other edge a lower lid on its lower hinge for pivotal movement in a vertical direction. The trunk is also formed at the top with an opening which is utilized when the head is accommodated within or emerged out of the upper room whereby the head in an emerged position locks to the upper edge of the upper lid. At the opposite sides of the upper room, two openings are utilized when the shoulders, arms and hands are accommodated within or extended out of the upper room. At the bottom, an opening is utilized when the legs and feed are accommodated within or extended out of the lower room whereby the feet is so constructed in an accommodated position to cover the opening of the bottom. The head is movably in a downward or upward vertical direction connected to an engaging pin mounted on the trunk within the upper room. The shoulders are respectively fixed through a shoulder rod to a shoulder articulation which is rotatably connected to a shoulder articulation axle mounted on the trunk within the upper room. The legs are respectively pivotally journaled to a leg articulation axle mounted on the trunk within the inner room.

In accordance with another aspect of the invention, the legs may preferably include, respectively, a thigh, and a lower leg which is adapted for accommodation of the thigh within a recess formed on the lower leg and is journaled to the thigh through a knee axle mounted on the lower leg. The shoulders may preferably be of a cylindrical shape and adapted for receiving an upper arm having a piston rod shape thereby to slidably engage with each other. The upper arm is pivotally connected to a lower arm to which the hand is rotatably connected to twist around a wrist axle fixedly connected to the lower arm.

In accordance with a further aspect of the invention, the upper lid and lower lid respectively function as the chest and abdomen, or the upper and lower lid as a whole function as the back, waist and hips, respectively.

While the specification concludes with the claims which particularly point out and distinctly claim that subject matter which is regarded as inventive, it is believed that the invention will be more clearly understood when considering the following detailed description taken in conjunction with the accompanying figures of the drawings forming a part of this specification, wherein like reference characters designate corresponding parts in the several views, and in which:

DESCRIPTION OF THE PREFERRED EMBODIMENTS

Figure 1:
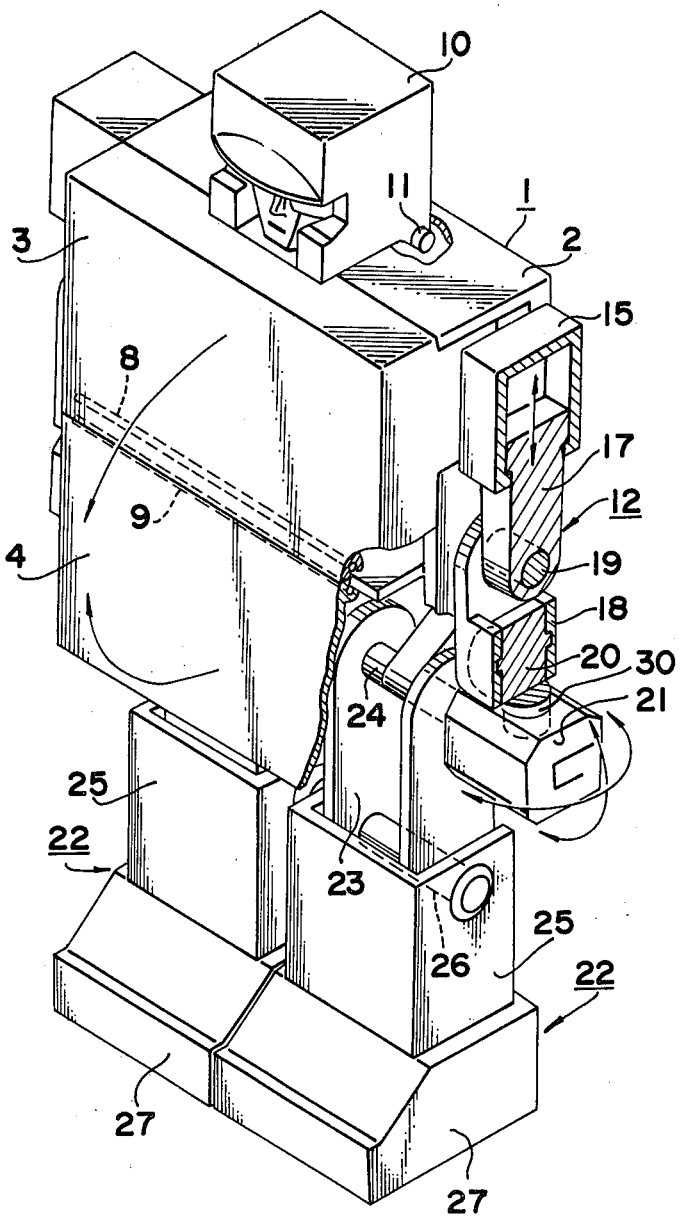
FIG. 1 is a perspective view, partly in section and broken away for better illustrating one embodiment of the toy doll of this invention.

The first embodiment of the toy doll according to the invention will now be described in detail with reference to FIGS. 1 to 3. The toy doll comprises a trunk 1, a head 10, a pair of arms 12 and a pair of legs 22 as the main elements. These are made of die cast aluminum alloy or synthetic resin. At the lower ends of the legs, there are feet 27 and at the lower extremities of the arms, there are hands 21.

The trunk 1 comprises a back region 2, an upper lid 3 and a lower lid 4 each corresponding to a chest and an abdomen, respectively. The trunk 1 is of a generally box shape with the front and bottom portion being opened, and has horizontally and centrally of the inner space a partition 5 which divides the space into an upper room 6 and a lower room 7. The upper lid 3 is supported at its lower edge onto a front upper portion of the partition with an upper hinge 8, so that the upper lid 3 can be moved pivotally around the hinge in a vertical direction. The lower lid 4 is also supported at its upper edge onto a front lower portion of the partition with a lower hinge 9, so that the lower lid 4 can be moved pivotally around the hinge in a vertical direction. The upper lid is provided with a top wall and side wall extending therefrom to confront the periphery of the upper portion of the back region 2. The back region 2 has a top wall which abuts to the upper lid top wall described above.

Figure 2:
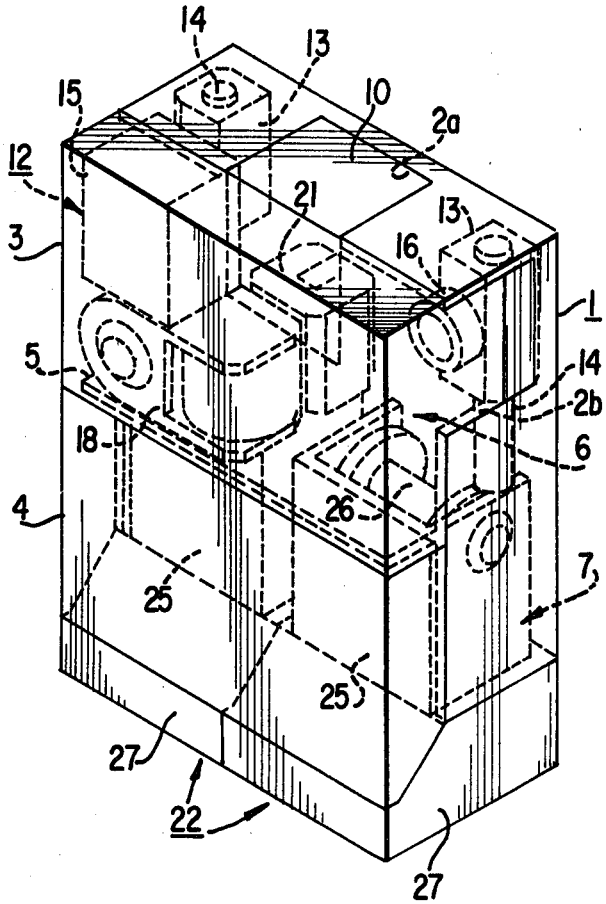
FIG. 2 is a perspective view of the embodiment shown in FIG. 1 wherein upper and lower lids are removed to clearly show the internal construction when the head, shoulders, arms, hands, legs and feet are accommodated within the trunk.
Figure 3:
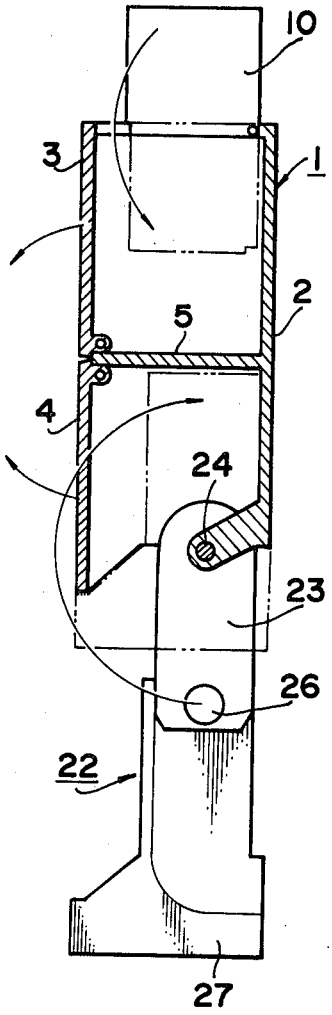
FIG. 3 is a side elevational view in section of the embodiment shown in FIG. 1.

The head 10 is connected at its rear bottom edge to the top wall of the trunk with the aid of a pair of engaging pins 11, so that it can move in a downward or upward vertical direction within and out of the upper room 6 through an opening 2*a* shown in FIG. 2. When the head 10 is emerged out of the upper room 6, the chin portion thereof is locked to the top wall of the upper lid 3 as shown in FIG. 1 so that it remains in an upright position unless the upper lid 3 is opened toward the front.

The arms generally designated by a reference numeral 12 are provided at the both sides of the trunk 1. Adjacent to the upper sides within the upper room 6 of the trunk 1, there are mounted shoulder articulation axles 14 on which shoulder articulations 13 are journaled rotatably in a horizontal direction. The shoulders 15 are connected through shoulder rods 16 to the shoulder articulations 13. Each shoulder 15 is of a cylindrical arrangement and is hollow so as to receive an upper arm 17 having a piston rod shape. The upper arm 17 is slidably coupled to the shoulder 15 within the hollow portion of the shoulder 15. The upper arm 17 connects a lower arm 18 with an elbow axle 19 so that the lower arm 18 can move pivotally around the axle 19. A hand 21 is connected to the lower arm 18 by means of a wrist axis 20 which has an integral cylindrical projection 30, the wrist axle being rotatably mounted on the lower arm 18 so that the hand 21 can move swingingly with respect to the lower arm 18, and the integral cylindrical projection 30 being rotatably inserted into the body of the hand 21 so that the hand 21 can also move perpendicularly with respect to the lower arm 18. Thus, the hand 21 can effect a swing and twist movement relative to the lower arm 18. In order to accommodate the arms within the trunk 1 as shown in FIG. 2, the hand 21 is twisted around the integral cylindrical projection 30, and then is turned around the wrist axle 20 to locate it at a predetermined position. Thereafter, the lower arm 18 with the hand thus positioned is turned around the elbow axle 19 upwardly. The upper arm 17 with the hand 21 and lower arm 18 thus positioned is pushed upwardly into the hollow portion of the shoulder 15. In this condition, with the upper lid 3 opened, the shoulder 15 and other above associated elements 17, 18 and 21 are accommodated within the upper room 6, by turning the shoulder 15 around the shoulder articulation axle 14, through an opening as shown in FIG. 2.

The legs 22 each respectively comprise a thigh 23, a lower leg 25 and a foot 27. The thigh 23 which comprises parallel plates is rotatably journaled on a leg articulation axle mounted on the back within the lower room 7 of the trunk 1. The lower leg 25 whose top and rear are open is journaled on a knee axle 26 so as to turn around the axis 26 for accommodation of the thigh 23 within a recess defined by side walls of the lower leg 25 to which the foot 27 is fixed. In order to accommodate the legs 22 within the trunk 1 as shown in FIG. 2, after opening the lower lid 4 upwardly, the lower leg 25 is folded up by turning it around the knee axle 26 so as to accommodate within the recess the thigh 23. The thigh 23 and lower leg 25 are then turned upward around the leg articulation axle 24 so as to be fully accommodated within the lower room 7. In this accommodated position, the bottom of the foot 27 serves as a bottom plane of the trunk 1.

In the accommodated position of the head 10, the arms 12 and the legs 22, as shown in FIG. 2, it is to be noted that the rear of the head 10 serves as a lid of the opening 2*a* of the trunk 1, the side of the shoulder articulation 13 serves as a lid of the opening 2*b* of the trunk 1, and the bottom of the foot 27 serves as a lid of the bottom opening of the trunk 1. As a result, in its entirety the toy doll, when the head 10, the arms 12 and the legs 22 are accommodated within the trunk, shows an outer appearance of a complete rectangular prism.

Figure 4:
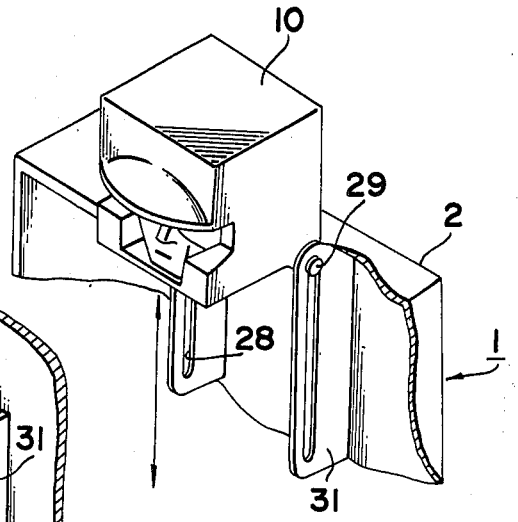
FIGS. 4 and 5 are perspective views respectively showing other embodiments of the mechanism for accommodating or extending the head and the legs and feet.
Figure 5:
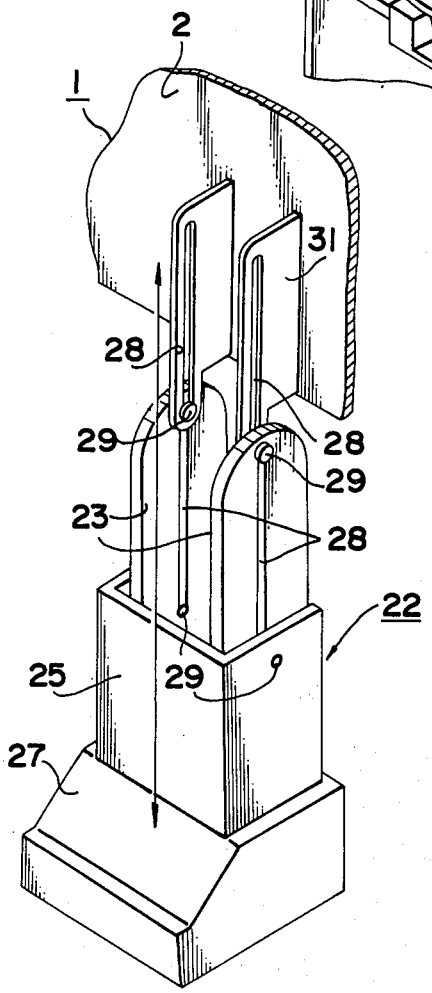

Referring now to FIGS. 4 and 5, there are shown other embodiments of the mechanisms to accommodate within or emerge out of the trunk a head and the feet, respectively. As is readily understood from FIGS. 4 and 5, such mechanism other than the above described mechanism may also be attained by providing with an elonated slit 28 in a projection integral with the back 2 of the trunk 1, and in the parallel plates of the thigh 23. In this case, both the head 10 and leg 22 are moved in a vertical direction which is different from the first embodiment in FIGS. 1 to 3.

As above described according to this invention, since the head, arms and legs of the toy doll can be fully accommodated within the trunk, it is not required to prepare a large location for the purpose of housing the doll in a toy case or some other place. Moreover, it is relatively free from damage to or breaking of the head, arms and legs during in such an accommodated state. Further it is more amusing to see the toy doll which changes so drastically as it shows an outer appearance of a rectangular prism.

While the invention has been shown and described in terms of some specific embodiments, it should be understood that many changes and modifications would be obvious to one skilled in the art without departing from the scope of the invention as defined in the appended claims.

What is claimed is:

1. A doll comprising a trunk defining a chest, addomen, back, waist and hips, and members simulating a head, shoulders, arms, hands, legs and feet, said trunk being of a generally box shape, having horizontally and centrally of the inner space a partition which defines an upper room and lower room within the trunk and fixedly connects at one upper edge thereof an upper lid on an upper hinge for pivotal movement in a vertical direction, and at a lower edge thereof a lower lid on a lower hinge for pivotal movement in a vertical direction, and forming at the top an opening which is utilized when the head is accommodated within or emerged out of said upper room whereby the head in an emerged position locks to the upper edge portion of said upper lid, at the opposite side openings which are utilized when the shoulders, arms and hands are accommodated within or extended our of said upper room, and at the bottom an opening which is utilized when the legs and feet are accommodated within or extended out of said lower room whereby the feet in an accommodated position cover said opening at the bottom, said head being rotatably moveable in a downward or upward vertical direction connected to an engaging pin mounted on said trunk within said upper room, said shoulders respectively being fixed through a shoulder rod to a shoulder articulation which is rotatably connected to a shoulder articulating axle mounted on said trunk within said upper room, and said legs respectively being pivotally journaled to a leg articulation axle mounted on said trunk within said inner room.

2. A doll according to claim 1, in which said legs include respectively a thigh, and a lower leg which is adapted for accommodation of said thigh within a recess formed on said lower leg and is journaled to said thigh through a knee axle mounted on said lower leg.

3. A doll according to claim 1, in which said shoulders are adapted for receiving an upper arm of said arm having a piston rod shape thereby to slidably engage with each other, and said upper arm pivotally connecting a lower arm to which said hand is rotatably connected thereby to swing and twist with respect to said lower arm.

4. A doll according to claim 1, in which said upper lid functions as the chest and said lower lid functions as the abdomen.

5. A doll according to claim 1, in which said upper and lower lid function as the back, waist and hips.

* * * * *